United States Patent [19]

MacArthur et al.

[11] Patent Number: 4,874,506

[45] **Date of Patent: * Oct. 17, 1989**

[54] CATALYTIC TWO-STAGE COAL HYDROGENATION PROCESS USING EXTINCTION RECYCLE OF HEAVY LIQUID FRACTION

[75] Inventors: James B. MacArthur, Denville, N.J.; Alfred G. Comolli, Yardley, Pa.; Joseph B. McLean, Somerville, N.J.

[73] Assignee: HRI, Inc., Lawrenceville, N.J.

[ * ] Notice: The portion of the term of this patent subsequent to Aug. 1, 2006 has been disclaimed.

[21] Appl. No.: 109,646

[22] Filed: Oct. 16, 1987

Related U.S. Application Data

[63] Continuation-in-part of Ser. No. 876,307, Jun. 18, 1986, which is a continuation of Ser. No. 725,458, Apr. 22, 1985, abandoned.

[51] Int. Cl.[4] ..... C10G 1/00

[52] U.S. Cl. ..... 208/413; 208/417; 208/418

[58] Field of Search ..... 208/409, 413, 417, 418

[56] References Cited

U.S. PATENT DOCUMENTS

| | | | |
|---|---|---|---|
| 4,045,329 | 8/1977 | Johanson et al. | 208/417 |
| 4,054,504 | 10/1977 | Chervenak et al. | 208/417 |
| 4,134,821 | 1/1979 | Gorin | 208/417 |
| 4,316,792 | 2/1982 | Sze et al. | 208/49 X |
| 4,345,989 | 8/1982 | Vernon et al. | 208/419 X |
| 4,364,817 | 12/1982 | Anderson et al. | 208/417 |
| 4,391,699 | 7/1983 | Rosenthal | 208/418 X |
| 4,422,922 | 12/1983 | Rosenthal | 208/430 X |
| 4,569,749 | 2/1986 | Wright | 208/417 |

*Primary Examiner*—Patrick P. Garvin
*Assistant Examiner*—George R. Fourson
*Attorney, Agent, or Firm*—Fred A. Wilson

[57] ABSTRACT

A process for catalytic two-stage hydrogenation and liquefaction of coal with selective extinction recycle of all heavy liquid fractions boiling above a distillation cut point of about 600°-750° F. to produce increased yields of low-boiling hydrocarbon liquid and gas products. In the process, the particulate coal feed is slurried with a process-derived liquid solvent normally boiling above about 650° F. and fed into a first stage catalytic reaction zone operated at conditions which promote controlled rate liquefaction of the coal, while simultaneously hydrogenating the hydrocarbon recycle oils. The first stage reactor is maintained at 710°-800° F. temperature, 1000-4000 psig hydrogen partial pressure, and 10-90 lb/hr per $ft^3$ catalyst space velocity. Partially hydrogenated material withdrawn from the first stage reaction zone is passed directly to the second stage catalytic reaction zone maintained at 760°-860° F. temperature for further hydrogenation and hydroconversion reactions. A 600°-750° F.+ fraction containing 0-20 W % unreacted coal and ash solids is recycled to the coal slurrying step. If desired, the cut point lower boiling fraction can be further catalytically hydrotreated. By this process, the coal feed is successively catalytically hydrogenated and hydroconverted at selected conditions, to provide significantly increased yields of desirable low-boiling hydrocarbon liquid products and minimal production of hydrocarbon gases, and no net production of undesirable heavy oils and residuum materials.

14 Claims, 2 Drawing Sheets

COAL
10
12
14
16
17
17a
H2
15
18
19
20
21
22
26
27
28
29
30
31
32
38
39
60
61
62
63
64
65
66
VENT GAS
67
68
69
70
72
LT. LIQUID PRODUCT
74
HVY. LIQUID PRODUCT
76
77
78
79
80
LIQUID PRODUCT
82
83
84
86
87
SOLIDS
88
89

CATALYTIC TWO-STAGE COAL HYDROGENATION PROCESS USING EXTINCTION RECYCLE OF HEAVY LIQUID FRACTION

The U.S. Government has rights in this invention pursuant to Contract No. DE-AC22-83PC60017 awarded by the U.S. Department of Energy.

BACKGROUND OF THE INVENTION

This application is a continuation-in-part of co-pending application Ser. No. 876,307 filed June 18, 1986, now allowed, which was a continuation of Ser. No. 725,458 filed Apr. 22, 1985 now abandoned.

This invention relates to an improved catalytic two-stage coal hydrogenation and hydroconversion process for producing increased yields of low-boiling hydrocarbon distillate liquid products without production of heavy oils. It relates particularly to such a process in which the coal feed is catalytically hydrogenated in a first reaction zone containing an ebullated catalyst bed, and then further hydrogenated and hydrocracked in a second ebullated catalyst bed reaction zone at higher severity conditions to produce increased yields of desirable low-boiling hydrocarbon liquid products, by utilizing extinction recycle of all hydrocarbon liquid materials boiling above a critical distillation cut point temperature between about 600° and 750° F.

In the H-Coal® single stage coal liquefaction process, a particulate coal feed is slurried usually in a coal-derived recycle oil and the resulting coal-oil slurry is preheated to near the reaction temperature and fed with hydrogen into a catalytic ebullated bed reactor, which operates at relatively high temperature and pressure conditions. In the reactor, a major portion of the coal is liquefied and hydroconverted to produce hydrocarbon gas and distillate liquid fractions, but an undesirably large fraction of the coal liquefaction product is residual oil containing preasphaltenes and asphaltene compounds. In the reactor, the preasphaltenes and asphaltenes break down further to form heavy and light distillates, naphtha and gaseous hydrocarbons. In order to achieve satisfactory hydrocarbon liquid products in singlestage catalytic reaction processes, the reactor must be operated in a relatively high temperature which produces some heavy retrograde materials and places a limit on the distillate liquid yields which can be achieved. Conventional single-stage catalytic processes for coal liquefaction and hydrogenation are generally disclosed in U.S. Pat. Nos. 3,519,555, 3,791,959, and 4,045,329.

In attempts to overcome the deficiencies of single-stage catalytic processes for coal hydrogenation and liquefaction, various two-stage catalytic processes have been proposed, including processes having a thermal first stage reactor as well as catalytic-catalytic processes utilizing low first stage temperature of only 600°–700° F. Examples of such coal hydrogenation processes using two stages of catalytic reaction are disclosed by U.S. Pat. Nos. 3,679,573, 3,700,584, 4,111,788, 4,350,582, 4,354,920, and 4,358,359. Although these prior two stage coal hydrogenation processes have generally provided improvements over single stage coal liquefaction processes, such processes usually produce low quality liquid solvent materials in the first stage reactor and do not provide for the desired hydrogenation and high conversion of the coal feed to produce high yields of desirable low-boiling hydrocarbon liquid products with minimal yields of hydrocarbon gas and heavy residuum fractions.

Although substantial improvement in catalytic two-stage coal liquefaction processes have been made recently, further improvements in the yields of low-boiling $C_4$-975° F. hydrocarbon liquid product fractions are desired. Such improved results have now been unexpectedly achieved by the present catalytic two-stage coal hydrogenation and hydroconversion process, in which a heavy hydrocarbon liquid fraction normally boiling above a critical distillation temperature is recycled for extinction reactions, and the yield of hydrocarbon liquid products boiling below the critical distillation temperature is appreciably increased.

SUMMARY OF INVENTION

The present invention provides an improved process for the direct two-stage catalytic hydrogenation, liquefaction and hydroconversion of coal using selective extinction recycle of a heavy process-derived hydrocarbon liquid fraction boiling above a critical distillation cut point temperature of 600°–750° F., so as to produce significantly increased yields of desirable low-boiling hydrocarbon distillate liquid products along with minimal yields of hydrocarbon gas and no net production of residuum fractions boiling above the cut point temperature. Thus, the term extinction recycle means that the recycle oil stream boiling above the critical distillation temperature is substantially equal to the slurrying oil requirement for the coal feed, and therefore results in a zero net yield of recycle boiling range hydrocarbon materials.

It is an important feature of this invention that by providing a proper combination of operating conditions in the first and second stage ebullated bed catalytic reactors in combination with a distillation cut point temperature at atmosphere pressure within the range of 600°–750° F. and effective separation of solids from the hydrocarbon liquid material boiling above the cut point temperature to less than about 20 W % solids remaining, that the coal feed is effectively hydrogenated and converted principally on a once-through basis so that recycle of unconverted residuum and solids is minimized, and the yield of low-boiling hydrocarbon liquid product is significantly enhanced. The residuum and solids content in the first stage reactor is maintained less than about 50 W % so that effective catalyst bed ebullation is not adversely affected, and the yield of heavy oils boiling above the distillation cut point temperature of 600°–750° F. is less than about 20 W %, and the yields of $C_4$-cut point temperature product is at least about 60 W % of the coal feed.

In the process, a particulate coal such as bituminous or sub-bituminous and a heavy process-derived recycled hydrocarbon liquid solvent material normally boiling above the distillation cut point of 600°–750° F. are first mixed together to provide a flowable and operable solvent/coal weight ratio of between 1.0 and 4.0 but require minimal solvent oil. The resulting coal-oil slurry is hydrogenated and liquefied using two stage close-coupled ebullated bed catalytic reactors connected in series.

The coal-oil slurry is fed into the first stage catalytic reaction zone which is maintained at selected moderate temperature and pressure conditions and in the presence of a particulate hydrogenation catalyst which promotes controlled rate hydrogenation and liquefaction of the coal, while simultaneously hydrogenating the recycle solvent oil at conditions which favor hydrogenation reactions at temperatures usually less than about 800° F. The first stage reaction zone contains an ebullated bed of a particulate hydrogenation catalyst to hydrogenate the particulate feed coal, recycled solvent oil and dissolved coal molecules and produce a partially converted hydrocarbon effluent material.

The first stage reaction zone is maintained at conditions of 700°-800° F. temperature, 1000-4000 psig hydrogen partial pressure, and coal feed rate or space velocity of 10-90 lb coal/hr per $ft^3$ catalyst settled volume to hydrogenate and substantially liquefy the coal and produce a high quality hydrocarbon solvent material, while achieving greater than about 80 W % conversion of the coal to tetrahydrofuran (THF) soluble materials. At such mild reaction conditions, hydrocracking, condensation and polymerization reactions along with formation of undesired hydrocarbon gases are all advantageously minimized. The mild reaction conditions used permit the coal catalytic hydrogenation and solvent regeneration reactions to keep pace with the rate of coal conversion. Preferred first stage reaction conditions are 720°-780° F. temperature, 1500-3500 psig hydrogen partial pressure and coal space velocity of 20-70 lbs coal/hr per $ft^3$ catalyst settled volume, with the preferred conditions being specific to the type of coal being processed.

The catalyst used should be selected from the group consisting of a metal or oxides of cobalt, iron, molybdenum, nickel, tin, tungsten and mixtures thereof, and other hydrocarbon hydrogenation catalyst metals or oxides known in the art and deposited on a base material selected from the group consisting of alumina, magnesia, silica, titania, and similar materials. Useful catalyst particle sizes can range from about 0.030 to 0.125 inch effective diameter.

From the first stage reaction zone, the total effluent material is passed with additional hydrogen directly to the close-coupled second stage catalytic reaction zone, where the material is further hydrogenated and hydrocracked at a temperature at least about 25° F. higher than for the first stage reaction zone. Both stage reaction zones are upflow, well mixed ebullated bed catalytic reactors. For the second stage reactor, operating conditions are maintained at higher severity conditions which promote more complete hydroconversion of the coal to hydrocarbon liquids, hydroconversion of primary liquids to distillate products, and provide product quality improvement via heteroatoms removal at temperature greater than 800° F., and include hydrogen pressure similar to the first stage reaction zone and a hydroconversion catalyst. The desired second stage reaction conditions are 760°-860° F. temperature, 1000-4000 psig hydrogen partial pressure and coal space velocity of 10-90 lb coal/hr per $ft^3$ catalyst settled volume to achieve at least about 90 W % conversion of the remaining reactive coal along with the asphaltene and preasphaltene compounds to lower boiling hydrocarbon materials, and the heteroatoms are further reduced to provide tetrahydrofuran (THF) soluble materials. The reactor space velocity is adjusted to achieve the complete conversion of heavy oils and residuum boiling above the cut point temperature to produce lower-boiling hydrocarbon liquid products. Preferred second stage reaction conditions are 780°-850° F. temperature, 1500-3500 psig hydrogen partial pressure and coal space velocity of 20-70 lb coal/hr per $ft^3$ catalyst settled volume.

The effluent material from the second stage reaction zone is phase separated to remove gas fractions, and the resulting liquid fraction is distilled at a critical cut point temperature of 600°-750° F. and at substantially atmospheric pressure. The hydrocarbon material boiling below the cut point temperature is withdrawn as product, while particulate solids of uncoverted coal and ash are separated from the cut point plus (650° F.+) material to provide a hydrocarbon liquid stream containing less than about 20 W % solids remaining. This 650° F.+ liquid containing particulate solids less than about 20 W % and preferably 0-15 W % solids is recycled to the first stage reactor for extinction reactions. In accordance with the invention, the recycle oil critical cut point temperature is adjusted in combination with the process reaction conditions to produce substantially no net yield of hydrocarbon liquid product material boiling above the cut point temperature. Also if desired, the 650° F.− fraction can be passed to a third stage fixed bed catalytic reactor for hydrotreating to further remove undesired materials such as nitrogen and sulfur containing compounds.

The present staged catalytic coal liquefaction process provides temperature staged reactors to provide balanced rates for numerous simultaneous and complex reactions, and provides high selectivity to low-boiling hydrocarbon liquid products and desired low yields of $C_1$-$C_3$ hydrocarbon gases and residuum materials, together with minimal deactivation of the catalyst which provides for extended activity and useful life of the catalyst. Overall, the present catalytic two-stage hydrogenation process produces higher yields of distillate and lower molecular weight hydrocarbon liquid products which are considerably more paraffinic and "petroleum-like" in terms of their chemical structure, than are produced by either single stage or other two-single direct coal liquefaction processes. The process advantageously provides a significant improvement over prior two-stage coal liquefaction processes, by providing for recycle to the first stage reaction zone of the process-derived liquid fraction boiling above the 600°-750° F. cut point temperature, and which contains less than about 20 W % solids, and preferably 0-15 W % solids to minimize viscosity of the recycle stream.

The reaction conditions are selected to provide controlled hydrogenation and conversion of the coal to liquid products, while simultaneously hydrogenating the recycle and coal-derived product oils. Because the coal feed is dissolved in a high quality hydrocarbon solvent in the lower temperature first-stage reactor, the potential for retrogressive (coke forming) reactions is significantly reduced and solvent quality, hydrogen utilization and heteroatom removal are appreciably improved, which increases potential conversion of the coal while extending the catalyst lift. The high quality effluent slurry material from the first stage reactor is fed to the close-coupled second stage reactor operated at somewhat higher temperatures, and the 600°-750° F.+ hydrocarbon liquid fraction containing reduced solids concentration is recycled to extinction to produce significantly increased yield of distillate liquid products. Such extinction recycle of the 650° F.+ hydrocarbon liquid fraction has previously been difficult or even impossible to accomplish, because of the relatively large fraction of the residuum material produced by the prior art processes. However, because of the improved hydroconversion results and increased yields of 650° F.− materials achieved by the present process, the 650° F.+ fraction is sufficiently small and contains low solids concentration so that it can be recycled to the first stage reactor for further hydroconversion reactions and eliminated from the process.

Thus, the present process advantageously achieves higher yields of hydrocarbon distillate and lower molecular weight liquid products and less heteratoms with lower energy input and catalyst usage than for single stage and other two-stage coal hydrogenation and liquefaction processes. The net products from the present process are controlled to yield $C_1$–$C_3$ gases, $C_4$-750° F. distillate, and a solids stream containing principally unconvertable mineral matter or ash and minimal or substantially no hydrocarbon liquid material. Also, the recycle to extinction of the 650° F.+ hydrocarbon liquid material eliminates any net production of these undesirable heavy oils containing polynuclear aromatics, which are generally believed to have carcinogenic and mutogenic characteristics.

BRIEF DESCRIPTION OF INVENTION

DESCRIPTION OF INVENTION

Figure 1:
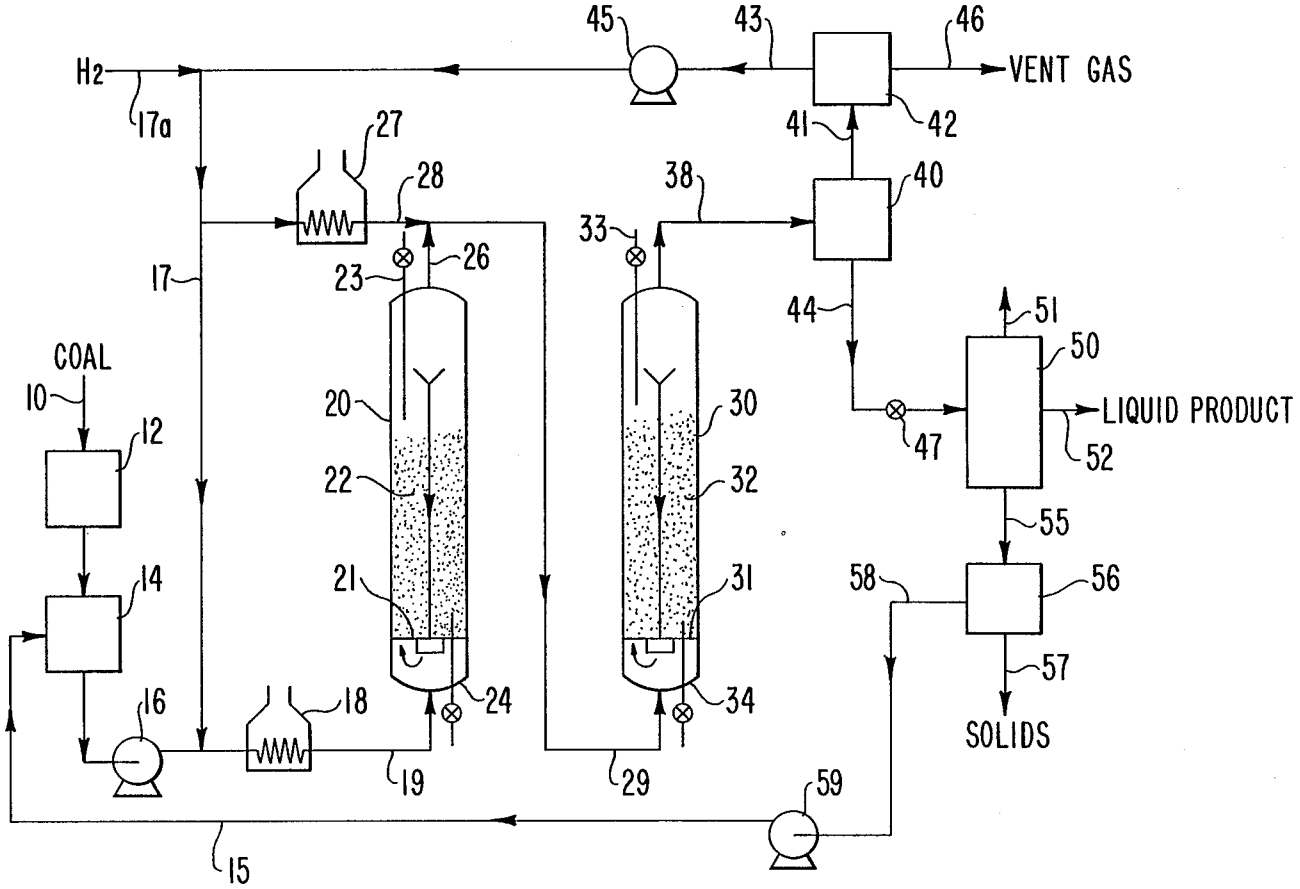
FIG. 1 is a schematic flow diagram of a catalytic two-stage coal hydrogenation and liquefaction process in accordance with the invention.

In the present invention, improved hydrogenation and liquefaction of coal is achieved by a two-stage catalytic process using two well-mixed ebullated bed catalytic reactors direct-connected in series. As is shown in FIG. 1, a coal such as bituminous or sub-bituminous type is provided at 10 and passed through a coal preparation unit 12, where the coal is ground to a desired particle size range such as 50–375 mesh (U.S. Sieve Series) and dried to a desired moisture content such as 1–15 W % moisture. The particulate coal is then slurried at tank 14 with sufficient process-derived recycle solvent liquid 15 having a normal boiling temperature above 650° F. to provide a flowable slurry. The weight ratio of solvent oil/coal should be minimized and is usually in a low operable range of 1.0–4.0, with a weight ratio range of 1.1–3.0 usually being preferred. The coal-/oil slurry is pressurized at pump 16, mixed with recycled hydrogen at 17, preheated at heater 18 to 600°–650° F. temperature and is then fed into the lower end of first stage catalytic ebullated bed reactor 20. Fresh make-up high-purity hydrogen is provided at 17*a* as needed.

The coal/oil slurry and hydrogen streams enter reactor 20 containing an ebullated catalyst bed 22, passing uniformly upwardly through flow distributor 21 at a flow rate and at temperature and pressure conditions to accomplish the desired hydrogenation reactions. The operation of the ebullated bed catalytic reactor including recycle of reactor liquid upwardly through the expanded catalyst bed is generally well known and is described by U.S. Pat. No. 4,437,973, which is incorporated herein by reference. The first stage reactor 20 preferably contains a particulate hydrogenation catalyst such as cobalt molybdate, nickel molybdate, or nickel tungsten on an alumina or silica support material. In addition, fresh particulate hydrogenation catalyst may be added to reactor 20 at connection 23 in the ratio of about 0.1 to 4.0 pounds of catalyst per ton of coal processed. Spent catalyst may be removed from reactor 20 at connection 24 as needed to maintain the desired catalytic activity within the reactor.

Operating conditions in the first stage reactor are maintained at moderate temperature range of 700°–800° F., 1000–4000 psig hydrogen partial pressure, and coal feed rate or space velocity of 10–90 lb coal/hr per $ft^3$ catalyst settled volume in the reactor. The preferred reaction conditions are 720°–780° F. temperature, 1500–3500 psig hydrogen partial pressure and feed rate of 20–70 lb coal/hr per $ft^3$ catalyst settled volume in the reactor and will be specific to the particular coal being processed, because different coals convert to liquids under thermal conditions at different rates. The optimal first stage reaction conditions will allow maximum utilization of hydrogen shuttling solvent compounds, such as pyrene/hydropyrenes known to be present in coal-derived recycled oils, since catalytic rehydrogenation of donor species occurs simultaneously with solvent-to-coal hydrogen transfer. Coal-derived oils are also exposed to an efficient catalytic hydrogenation atmosphere immediately upon their formation, thereby reducing the tendency for regressive repolymerization reactions which lead to poor quality hydrocarbon liquid products. First stage reactor thermal severity has been found to be quite important, as too high a severity leads to a coal conversion rate which is too rapid for the catalytic hydrogenation reactions to keep pace, as well as provides poorer hydrogenation equilibrium for the solvent compounds. Too low a thermal severity in the first stage, while still providing an efficient atmosphere for solvent hydrogenation, does not provide sufficient coal conversion to provide a significant process improvement.

In the first stage reactor, the objective is to hydrogenate the aromatic rings in molecules of the feed coal, recycle solvent and dissolved coal so as to produce a high quality hydrogen donor solvent liquid in the presence of hydrogen and the hydrogenation catalyst. At the moderate catalytic reaction conditions used, heteroatoms are removed, retrogressive or coke forming reactions are essentially eliminated, and hydrocarbon gas formations are effectively minimized. Because of the reaction conditions used, i.e., relatively low temperature first stage, the catalyst promotes coal hydrogenation and minimizes polymerization and cracking reactions. Also because of these improved conditions in the first stage reactor, less coke is deposited on the catalyst at the milder reaction conditions used, and the deposited coke also has a desirably higher hydrogen/carbon ratio than for prior coal liquefaction processes, which minimizes catalyst deactivation and appreciably prolongs the effective life of the catalyst.

From the first stage reactor 20, the total effluent material at 26 is mixed with additional hydrogen preheated at 27 and flows through conduit 29 directly to the lower end of close-coupled second stage catalytic reactor 30. By close-coupled reactors is meant that the volume of the connecting conduit 29 extending between the first and second stage reactors (and in which no catalytic contact with the effluent material occurs) is about 1–8% of the volume of the first stage reactor, and is preferably 1.4–6% of the first stage reactor volume. This reactor 30 which operates similarly to reactor 20 contains flow distributor grid 31 and catalyst bed 32, and is operated at a temperature at least about 25° F. higher than for the first stage reactor, and usually in the temperature range of 760°–860° F., but at temperatures lower than conventionally used for single-stage catalytic coal liquefaction processes. The higher temperature used in reactor 30 may be accomplished by utilization of the preheated hydrogen stream 28 as well as the second stage reactor heat of reaction. The second stage reactor pressure is slightly lower than for the first stage reactor to permit forward flow of the coal slurry material without any need for pumping, and additional makeup hydrogen is added at 28 to the second stage reactor as needed. A particulate catalyst similar to that used in the first stage reactor is utilized in bed 32 for the second stage reactor and is preferably cobalt-moly or nickel-moly on porous alumina support material.

In the second stage reactor 30, the reaction conditions are selected to provide a more complete catalytic conversion of the unconverted coal to liquids, utilizing the high quality solvent liquid produced in the first stage reactor. The remaining reactive coal as well as preasphaltenes and asphaltenes are converted to distillate liquid products along with additional heteroatoms removal. Substantial secondary conversion of coal derived liquids to distillate products, and product upgrading by heteroatoms removal, is also accomplished in the second stage reactor. The reaction conditions are selected to minimize gas formation or dehydrogenation of the first stage liquid effluent materials. Useful reactor conditions are 760°–860° F. temperature, 1000–4000 psig hydrogen partial pressure, and coal space velocity of 10–90 lb/hr per $ft^3$ catalyst settled volume. Preferred reaction conditions will depend on the particular type coal being processed, and are usually 750°–850° F. temperature 1500–3500 psig hydrogen partial pressure, and space velocity of 25–70 lb coal/hr per $ft^3$ catalyst settled volume.

It is an important characteristic of this process that very little change in the hydrocarbon compounds composition occurs between the first and second stage reactions. It has been found that the 850° F.− distillate liquids contain much lower levels of condensed aromatics and are significantly more aliphatic than are such products produced from a conventional single stage catalytic coal hydrogenation process. Recycle of 850° F.+ residual oil greatly enhances hydrogenation and hydroconversion in the first stage reactor.

From the second stage reactor 30, the effluent material at 38 is passed to a phase separator 40 operating at near reactor conditions, wherein a vapor fraction 41 is separated from a solids-containing liquid slurry fraction at 44. The vapor fraction 41 is treated at hydrogen purification section 42, from which hydrogen stream 43 is withdrawn for recycle by compressor 45 to the reactors 20 and 30. Fresh high purity make-up hydrogen is added at 17*a* as needed. A vent gas containing undesired nitrogen and sulfur compounds is removed as stream 46.

The slurry liquid 44 is pressure-reduced at 47 to near atmospheric pressure, and passed to a distillation system generally shown at 50. The resulting liquid fractions are recovered by a vapor/liquid flash in the distillation system 50, which includes atmospheric and/or vacuum distillation steps to produce light distillate product stream 51 and a heavier higher-boiling distillate liquid product stream 52. The boiling point of overheads stream 51 is controlled at a distillation cut point about 600°–750° F. such as by steam or vacuum distillation procedures to provide the net oil fractions normally boiling at 600°–750° F.+ in bottoms stream 55. The bottoms stream 55 is passed to an effective liquid-solids separation step 56, from which a stream containing an increased concentration of unconverted coal and ash solids material and substantially no hydrocarbon liquid is removed at 57. The remaining liquid stream 58 normally boiling at 600°–750° F. and having a reduced solids concentration less than abut 20 W % solids and preferably 0–15 W % solids is recycled by pump 59 as slurring oil 15 to slurry tank 14. Solids concentration in the recycle liquid stream 58 exceeding about 20 W % produces excessive viscosity and pumping difficulties for the recycled oil stream, and also reduces the amount of fresh coal which can be slurried for feeding to the process.

The unconverted coal and ash solids are preferably substantially completely removed from stream 58 to provide for recycle of a 600°–750° F. heavy hydrocarbon liquid stream to the coal slurrying step, so as to achieve substantially total conversion of all the 600°–750° F. fraction oils to light distillate products and avoid production of any heavy oils which are generally considered carcinogenic.

The recycle oil preparation in liquid-solids separation step 56 is improved by reducing its solids concentration (ash and unconverted coal) to less than about 20 W % and preferably to 0–15 W % by using known solids removal means in separation step 56, such as centrifuges, filtration, extraction or solvent deashing techniques which are known in the industry. Separation of solids from the recycle oil can be facilitated by precleaning the coal feed.

The resulting slurrying liquid at 58 is then recycled as stream 15 back to the mixing step at 14, where it is mixed with the coal feed to the first stage reactor to provide a flowable slurry having an oil/coal weight ratio of 1.0–4.0, and preferably 1.1–3.0 ratio.

Figure 2:
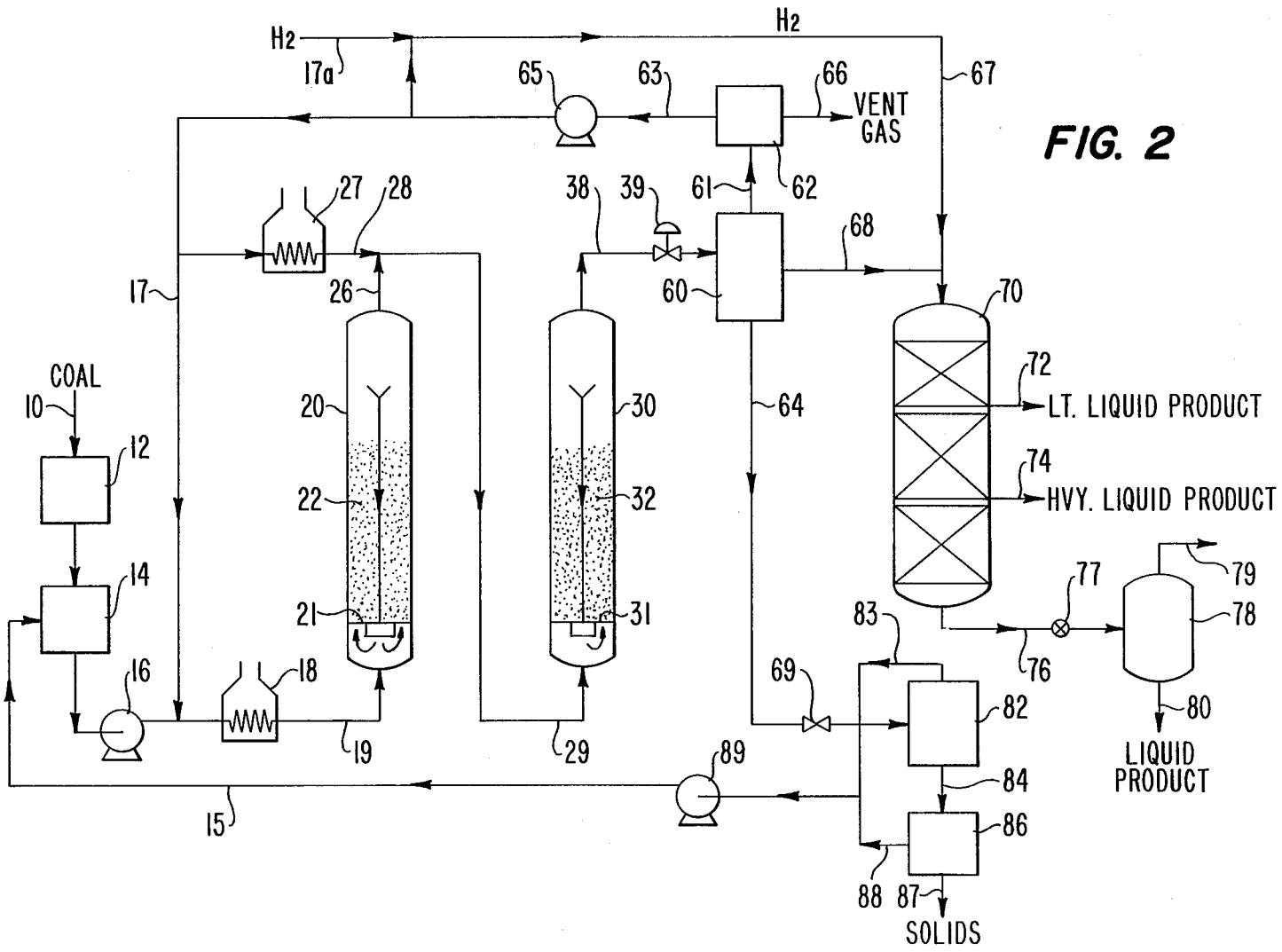
FIG. 2 is a schematic flow diagram of the process, including a third stage catalytic reactor for hydrotreating a coal-derived liquid product fraction to produce desired light hydrocarbon liquid fuel products.

Another useful embodiment of this invention is shown by FIG. 2, in which a portion of the second stage reactor effluent is hydrotreated in a third stage catalytic reactor. From the second stage reactor 30 the effluent material at 38 is pressure-reduced at 39 and passed to a phase separator 60, in which vapor fraction 61 is separated from a solids-containing liquid slurry fraction at 64. The vapor fraction 61 is treated in hydrogen purification unit 62, from which hydrogen-rich stream 63 is withdrawn for recycle by pump 65 to the reactors 20 and 30 as described for the FIG. 1 embodiment. Vent gas is removed at 66.

Also from phase separator 60, liquid stream 68 containing hydrocarbon fractions generally boiling below a cut point of 600°–650° F. is passed to third stage catalytic reactor 70 for additional hydrotreating to further remove undesired materials such as nitrogen and sulfur compounds, and to saturate the aromatics and olefins present. Reactor 70 is usually a fixed bed catalyst unit in which catalytic hydrotreatment of the medium boiling hydrocarbon liquid is carried out at relatively severe conditions of 650°–775° F. temperature, 1500–2000 psig hydrogen partial pressure, and space velocity of 0.5–2.0 $V_f/hr/V_r$ (volume feed per hour per volume of reactor). Because of the higher quality low-boiling liquid fraction obtained from the second stage reactor, it can be hydrotreated at lower temperature and pressure conditions than those used in the second stage reactor 30. The catalyst used in reactor 70 can be the same as in the other reactors, but is preferably a known hydrocracking catalyst such as co-moly or ni-moly on alumina support. If desired, side streams of hydrogen gas (not shown) can be added to reactor 70 to control the reaction temperatures in the catalyst beds therein at the desired range. A light refined liquid product boiling in the gasoline range is withdrawn at 72, and a heavier liquid product boiling in the diesel fuel range is withdrawn at 74.

From reactor 70, the resulting bottoms fraction stream at 76 is pressure-reduced at 77 and can be cooled by a heat exchanger (not shown) and passed to phase separator 78 operated at substantially atmospheric pressure. From separator 78 an overhead gaseous stream 79 containing light hydrocarbon liquid such as gasoline is withdrawn, and an atmospheric bottoms product oil is withdrawn at 80.

From phase separator 60, the bottoms liquid fraction stream 64 generally boiling above about 600°–750° F. is pressure-reduced at 69 to near atmospheric pressure, such as about 200 psig and passed to phase separator 82. From separator 82, a liquid fraction 83 is recycled by pump 89 as slurrying oil 15 to slurry tank 14. Also if desired, a portion 83*a* of liquid fraction 83 can be recycled to feed stream 68 to further upgrade that material in the hydrotreater 70. Separator bottoms fraction 84 is passed to an effective liquid-solids separation step 86, from which an increased concentration of unconverted coal and ash solids are removed as stream 87 similarly as for the FIG. 1 embodiment. The resulting liquid stream 88 containing a reduced solids concentration of less than 20 W % solids and preferably 0–15 W % solids is recycled by pump 89 as the slurrying oil 15 to the coal slurrying tank 14.

This invention will be further described and better understood by reference to the following Examples of comparative operations, which Examples should not be construed as limiting the scope of the invention.

EXAMPLE 1

Comparative runs were made using the present catalytic two-stage coal hydrogenation process on Wyodak sub-bituminous coal at the reaction conditions shown in Table 1, i.e., first stage reactor at 750° F. temperature and second stage at 825° F. temperature and a distillation cut point above 600° F.

From the results provided in Table 1, it is seen that substantially improved yields of the 390°–650° F. product fraction were achieved by extinction recycle of 600° F.+ liquid fraction, as compared to results for the prior standard two-stage catalytic coal liquefaction process operating at substantially the same reaction conditions, and in which a 550° F.+ oil is produced and recycled. It will also be noted that for the present two-stage catalytic process with extinction recycle of heavy oils, the recycle liquid contained more 650° F.+ material and the yields of desirable $C_4$-650° F. hydrocarbon liquid products were significantly greater than for the prior two-stage catalytic hydrogenation processes.

TABLE 1

CATALYTIC TWO-STAGE LIQUEFACTION OF WYODAK COAL USING EXTINCTION RECYCLE

| Operating Conditions: | | | |
|---|---|---|---|
| First Stage Temperature, °F. | | 750 | |
| $H_2$ Partial Pressure, psig | | 2500 | |
| Solvent/Coal, Weight Ratio | | 1.5/1 | |
| Coal Space Velocity, Lbs/Hr $Ft^3$ Catalyst | | 44 | |
| Catalyst, 1st Stage Reactor | | Ni—Mo/Alumina | |
| Second Stage Temperature, °F. | | 825 | |
| Catalyst, 2nd Stage Reactor | | Co—Mo/)Alumnina | |
| | | EXTINCTION RECYCLE | |
| Liquid Recycle Mode: | Standard | Experiment | Adjusted* |
| Continuous Atmospheric Still Reboiler Temperature, °F. | 550 | 610 | 590–600 |
| Net Products, W % M.A.F Coal | | | |
| $C_1$–$C_3$ Gas | 8.1 | 8.1 | 8.1 |
| $C_4$–390° F. Liquid | 25.0 | 21.8 | 21.8 |
| 390–650° F. Liquid | 36.5 | 47.4 | 44.7 |
| 650–975° F. Liquid | 4.2 | −1.5 | 0 |
| 975° F. + Residuum | 1.9 | −1.2 | 0 |
| Insoluble Organic Matter | 10.7 | 11.1 | 11.1 |
| $H_2O$ | 17.9 | 18.3 | 18.3 |
| $H_2S$, $NH_4$, $CO_x$ | 3.6 | 3.7 | 3.7 |
| TOTAL | 107.9 | 107.7 | 107.7 |
| $C_4$-650° F. Liquid Product, W % MAF Coal | 61.5 | 69.2 | 66.5 |

| Recycle Solvent Composition: | Standard | Extinction Recycle |
|---|---|---|
| IBP-650° F., W % | 61.7 | 34.3 |
| 650–975° F., W % | 30.5 | 53.4 |
| 975° F. + Residuum, W % | 7.8 | 12.3 |
| | 100.0 | 100.0 |

*Adjusted to zero net yield of recycle oil stream by distillation cut point temperature adjustment.

EXAMPLE 2

Additional runs were made for this catalytic two-stage process on Illinois No. 6 bituminous coal feed. The reaction conditions and comparative results are shown below in Table 2.

TABLE 2

HEAVY OIL EXTINCTION RECYCLE OPERATIONS WITH ILLINOIS NO. 6 COAL

| | | EXTINCTION RECYCLE | |
|---|---|---|---|
| Conditions: | Standard | Experiment | Adjusted(1) |
| Catalyst Used | Ni-Moly | Ni-Moly | Ni-Moly |

TABLE 2-continued

HEAVY OIL EXTINCTION RECYCLE OPERATIONS WITH ILLINOIS NO. 6 COAL

| Conditions: | Standard | EXTINCTION RECYCLE Experiment | Adjusted[1] |
|---|---|---|---|
| First Stage Temp., °F. | 750 | 755 | 755 |
| Space Velocity, Lbs/Hr ft$^3$ Catalyst | 47 | 44 | 44 |
| Catalyst Age, Lbs Coal/Lb Catalyst | 265 | 239 | 239 |
| Second Stage Temp., F. | 800 | 810 | 810 |
| Distillation Cut Point, °F. | 610 | 620[2] | 620 |
| Yields, W % M.A.F Coal | | | |
| $C_1$–$C_3$ Gas | 5.8 | 7.3 | 7.3 |
| $C_4$–390° F. Liquid | 17.0 | 21.1 | 21.1 |
| 390–650° F. Liquid | 31.4 | 40.3 | 40.3 |
| 650–750° F. Liquid | 8.7 | 21.1 | 20.1 |
| 750–975° F. Liquid | 11.7 | (−0.5) | 0 |
| 975° F.+Material | 9.4 | (−0.5) | 0 |
| $C_4$-750° F. Material | 57.1 | 82.5 | 81.5 |
| 750° F.+Material | 27.1 | (−1.0) | 0 |

[1]Results adjusted for 750° F.+material extincted to 650–750° F. distillate yield.
[2]Distillation used $N_2$ gas stripping.

Based on these results provided in Table 2, it is noted that for the extinction recycle mode of operation the yields of $C_4$-750° F. material substantially exceed that achieved with the standard two-stage catalytic coal liquefaction process without extinction recycle of the material boiling above the distillation cut point temperature.

EXAMPLE 3

A hydrocarbon effluent material obtained from two-stage catalytic processing of Wyodak coal is pressure-reduced to 2000 psig pressure and phase separated, after which the vapor fraction normally boiling below 650° F. is catalytically hydrotreated in a fixed bed reactor to reduce nitrogen and sulfur containing compounds. The hydrotreating conditions used and product results achieved are provided in Table 3 below.

TABLE 3

HYDROTREATING COAL-DERIVED 650° F.−LIQUIDS

| Reaction Conditions: | | |
|---|---|---|
| Temperature, °F. | 715° F. | |
| Total Pressure, psig | 1800–2000 | |
| $H_2$ Partial Pressure, psig | 1650–1850 | |
| Liquid Hourly Space Velocity, Vf/hr/Vr | 1.5 | |
| Catalyst | Nickel-moly on Alumina | |
| | FEED | PRODUCT |
| Boiling Range, °F. | 108–640 | 56–600 |
| Gravity, °API | 36 | 40 |
| Aniline Point | 93 | 127 |
| Nitrogen, ppm | 935 | 0.09 |
| Oxygen, ppm | 1400 | 50 |
| Sulfur, ppm | 88 | 4.7 |
| Carbon, W % | 87.1 | 86.2 |
| Hydrogen, W % | 12.9 | 13.8 |

From these results, it is seen that increased yields of upgraded hydrocarbon liquid products are obtained including gasoline and diesel fuel oil boiling range products having reduced concentrations of nitrogen, oxygen and sulfur.

Although this invention has been described broadly and in terms of certain preferred embodiments thereof, it will be understood that modifications and variation of the process can be made within the spirit and scope of the invention, which is defined by the following claims.

We claim:

1. A process for catalytic two-stage hydrogenation of coal with selective liquid recycle to produce increased yields of low-boiling hydrocarbon liquid and gaseous products, comprising:

(a) feeding particulate coal and a hydrocarbon slurrying oil at an oil:coal weight ratio between 1.0 and 4.0 and a temperature below a distillation cut point temperature of 600°–750° F. into a pressurized first stage catalytic reaction zone containing coal-derived liquid and hydrogen and an ebullated bed of particulate hydrogenation catalyst;

(b) passing said coal and hydrogen upwardly through said first stage ebullated bed of particulate hydrogenation catalyst, said bed being maintained at 700°–800° F. temperature, 1000–4000 psig hydrogen partial pressure and space velocity of 10–90 lb coal/hr per ft$^3$ catalyst settled volume to rapidly heat the coal and catalytically hydrogenate it to produce a partially hydrogenated and hydroconverted coal-derived material;

(c) withdrawing said partially hydrogenated coal-derived material containing gas and liquid fractions from said first stage reaction zone, and passing said material directly to a close-coupled second stage catalytic reaction zone together with additional hydrogen, said second stage reaction zone being maintained at 760°–860° F. temperature and 1000–4000 psig hydrogen partial pressure for further reacting and hydrocracking the liquid fraction material therein with minimal dehydrogenation reactions to produce gas and lower boiling hydrocarbon liquid materials;

(d) withdrawing from said second stage catalytic reaction zone the hydrocracked material containing gas and liquid fractions, and phase separating said material into separate gas and liquid fractions;

(e) distilling said liquid fraction at 600°–750° F. temperature and passing the distillation bottoms from said distillation to a liquid-solids separation step, from which a liquid stream normally boiling above the 600°–750° F. distillation temperature and containing less than about 20 W % concentration of particulate solids is entirely extinction recycled to the coal slurrying step, and a stream containing an increased solids concentration and substantially no hydrocarbon liquid material is removed from said liquid-solids separation step as the sole additional stream resulting from said liquid-solids separation step; and (f) recovering hydrocarbon gas and low boiling $C_4$-750° F. fraction hydrocarbon liquid products from the process.

2. The process of claim 1, wherein the particulate hydrogenation catalyst for said first and second reaction zones is selected from the group consisting of oxides of cobalt, iron, molybdenum, nickel, tin, tungsten and mixtures thereof deposited on a base material selected from the group consisting of alumina, magnesia silica, and combinations thereof.

3. The process of claim 1, wherein said first stage reaction zone is maintained at 720°–780° F. temperature, 1500–3500 psig hydrogen partial pressure, and space velocity of 20–70 lb coal/hr per ft$^3$ catalyst settled volume.

4. The process of claim 1, wherein said second stage reaction zone is maintained at 780°–850° F. temperature and 1500–3500 psig hydrogen partial pressure.

5. The process of claim 1, wherein said first stage reaction zone contains a particulate hydrogenation catalyst comprising nickel and molybdenum on an alumina support material.

6. The process of claim 1, wherein said second stage reaction zone contains a particulate catalyst comprising cobalt and molybdenum on an alumina support material.

7. The process of claim 1, wherein the distillation cut point temperature is 620°–700° F.

8. The process of claim 1, wherein said liquid stream being extinction recycled to the coal slurrying step conains 0–15 W % concentration of particulate solids.

9. The process of claim 1, wherein a $C_4$-650° F. hydrocarbon liquid fraction from said gas-liquid phase separation step is catalytically hydrotreated at conditions of 650°–775° F. temperature, 1600–2000 psig hydrogen partial pressure and space velocity of 0.5–2.0 volume of feed per hour per volume of reactor to produce refined hydrocarbon liquid products.

10. The process of claim 1, wherein the coal feed is bituminous type coal.

11. The process of claim 1, wherein the coal feed is subbituminous type coal.

12. The process of claim 9, wherein said liquid fraction from said phase separation step is distilled at 630°–700° F. temperature to provide a liquid fraction stream boiling above 630° F., from which stream particulate solids are removed to 0–20 W% solids concentration, and the stream boiling above 630° F. and containing reduced solids content is extinction recycled to said first stage reactor.

13. A process for catalytic two-stage hydrogenation of coal with selective liquid recycle to produce increased yields of low-boiling hydrocarbon liquid and gaseous products, comprising:

(a) mixing particulate bituminous coal with sufficient coal-derived hydrocarbon liquid at an oil:coal weight ratio between 1.1 and 3.0 to provide a flowable slurry, and feeding the coal-oil slurry at a temperature below about 700° F. directly into a pressurized first stage catalytic reaction zone containing coal-derived liquid and hydrogen and an ebullated bed of particulate hydrogenation catalyst;

(b) passing the coal slurry and hydrogen upwardly through said first stage ebullated bed of particulate hydrogenation catalyst, said bed being maintained at 720°–780° F. temperature, 1500–3500 psig hydrogen partial pressure, and space velocity of 20–70 lb coal/hr per $ft^3$ catalyst settled volume to rapidly heat the coal and catalytically hydrogenate it to produce a partially hydrogenated and hydroconverted coal-derived material;

(c) withdrawing said partially hydrogenated coal-derived material containing gas and liquid fractions from said first stage reaction zone, and passing said material directly to a close-coupled second stage catalytic reaction zone together with additional hydrogen, said second stage reaction zone being maintained at 780°–850° F. temperature and 1500–3500 psig hydrogen partial pressure for further reaction and hydrocracking the liquid fraction therein with minimal dehydrogenation reactions to produce gas and lower boiling hydrocarbon liquid materials;

(d) withdrawing from said second stage catalytic reaction zone the hydrocracked material containing gas and liquid fractions, and phase separating said material into separate gas and liquid fractions;

(e) distilling said liquid fraction at 620°–700° F. temperature and passing the distillation bottoms to a liquid-solids separation step, from which a liquid stream normally boiling above the 620°–700° F. distillation temperature and containing less than 20 W % concentration of particulate solids is extinction recycled to the coal slurrying step, and a stream containing an increased solids concentration and substantially no hydrocarbon liquid material is removed from said liquid-solids separation step as the sole additional stream resulting from said liquid-solids separation step; and (f) recovering hydrocarbon gas and low boiling $C_4$-700° F. fraction hydrocarbon liquid products from the process.

14. A process for catalytic two-stage hydrogenation of coal with selective liquid recycle to produce increased yields of low-boiling hydrocarbon liquid and gaseous products, comprising:

(a) mixing particulate bituminous coal with sufficient coal-derived hydrocarbon liquid at an oil:coal weight ratio between 1.1 and 3.0 to provide a flowable slurry, and feeding the coal-oil slurry at temperature below about 700° F. directly into a pressurized first stage catalytic reaction zone containing coal-derived liquid and hydrogen and an ebullated bed of particulate hydrogenation catalyst;

(b) passing the coal slurry and hydrogen upwardly through said first stage ebullated bed of particulate hydrogenation catalyst, said bed being maintained at 720°–780° F. temperature, 1500–3500 psig hydrogen partial pressure, and space velocity of 20–70 lb coal/hr per $ft^3$ catalyst settled volume to rapidly heat the coal and catalytically hydrogenate it to produce a partially hydrogenated and hydroconverted coal-derived material;

(c) withdrawing said partially hydrogenated coal-derived material containing gas and liquid fractions from said first stage reaction zone, and passing said material directly to a second stage catalytic reaction zone together with additional hydrogen, said second stage reaction zone being maintained at 780°–850° F. temperature and 1500–3500 psig hydrogen partial pressure for further reaction and hydrocracking the liquid fraction therein with minimal dehydrogenation reactions to produce gas and low boiling hydrocarbon liquid materials;

(d) withdrawing from said second stage catalytic reaction zone the hydrocracked material containing gas and liquid fractions, and phase separating said material into separate gas and liquid fractions.

(e) distilling said liquid fraction at 600°–750° F. temperature and passing the distillation bottoms to a liquid-solids separation step, from which a liquid stream normally boiling above the 600°–750° F. distillation temperature and containing less than 20 W % concentration of particulate solids is entirely extinction recycled to the coal slurrying step, and a stream containing an increased solids concentration and substantially no hydrocarbon liquid material is removed from said liquid-solids separation step as the sole additional stream resulting from said liquid-solids separation step; and (f) passing a $C_4$-650° F. liquid fraction to a catalytic hydro-treating step operated at 650°–775° F. temperature, 1600–2000 psig hydrogen partial pressure and space velocity of 0.5–2.0 volume of feed per hour per volume of reactor and catalytically hydrotreating the liquid to produce gasoline and diesel fuel oil products.

* * * * *